US010283832B1

(12) United States Patent
Chayat et al.

(10) Patent No.: US 10,283,832 B1
(45) Date of Patent: May 7, 2019

(54) CAVITY BACKED SLOT ANTENNA WITH IN-CAVITY RESONATORS

(71) Applicant: VAYYAR IMAGING LTD., Yehud (IL)

(72) Inventors: Naftali Chayat, Kfar Saba (IL); Doron Cohen, Tel Aviv (IL)

(73) Assignee: VAYYAR IMAGING LTD., Yehud (IL)

( * ) Notice: Subject to any disclaimer, the term of this patent is extended or adjusted under 35 U.S.C. 154(b) by 0 days.

(21) Appl. No.: 15/853,996

(22) Filed: Dec. 26, 2017

(51) Int. Cl.

| | |
|---|---|
| ***H01Q 13/18*** | (2006.01) |
| ***H01Q 9/04*** | (2006.01) |
| ***H01Q 21/00*** | (2006.01) |
| ***H01P 1/208*** | (2006.01) |
| ***H01P 3/12*** | (2006.01) |

(52) U.S. Cl.
CPC ..... *H01P 1/2088* (2013.01); *H01P 1/2084* (2013.01); *H01P 3/121* (2013.01); *H01Q 9/0407* (2013.01); *H01Q 9/0485* (2013.01); *H01Q 13/18* (2013.01); *H01Q 21/005* (2013.01); *H01Q 21/0043* (2013.01)

(58) Field of Classification Search
CPC ..... H01P 1/2088; H01P 1/2084; H01P 3/121; H01Q 9/0407; H01Q 9/0485; H01Q 21/0043; H01Q 21/005; H01Q 13/18
See application file for complete search history.

(56) References Cited

U.S. PATENT DOCUMENTS 5,471,181 A * 11/1995 Park ..... H01P 5/028 333/246
2008/0238793 A1* 10/2008 Channabasappa ... H01Q 9/0457 343/767
2013/0127669 A1* 5/2013 Han ..... H01Q 9/0485 343/700 MS

OTHER PUBLICATIONS

Search Report in PCT Application No. PCT/IL2018/051 dated Mar. 6, 2019.

* cited by examiner

*Primary Examiner* — Hai V Tran
*Assistant Examiner* — Michael M Bouizza
(74) *Attorney, Agent, or Firm* — Mark Cohen; Pearl Cohen Zedek Latzer Baratz

(57) ABSTRACT

A compact wideband RF antenna for incorporating into a planar substrate, such as a PCB, having at least one cavity with a radiating slot, and at least one transmission line resonator disposed within a cavity and coupled thereto. Additional embodiments provide stacked slot-coupled cavities and multiple coupled transmission-line resonators placed within a cavity. Applications to ultra-wideband systems and to millimeter-wave systems, as well as to dual and circular polarization antennas are disclosed.

16 Claims, 7 Drawing Sheets

CAVITY BACKED SLOT ANTENNA WITH IN-CAVITY RESONATORS

FIELD

The present invention relates to radio frequency antennas, and in particular to cavity-backed slot antennas employed in communications, radar and direction finding, and microwave imaging technologies.

BACKGROUND

Antennas are critical components in communications, radar and direction finding systems, interfacing between the RF circuitry and the environment. RF circuitry is often manufactured using printed circuit board (PCB) technology, and numerous engineering and commercial advantages are realized by integrating the RF antennas directly on the same printed circuit boards as the circuitry. Doing so improves product quality, reliability, and form-factor compactness, while at the same time lowering manufacturing costs by eliminating fabrication steps, connectors, and mechanical supports.

There is a variety of PCB antennas, including microstrip patch antennas that radiate perpendicularly to the PCB, slot antennas that radiate perpendicularly to the PCB in both directions, and printed Vivaldi and Yagi antennas that radiate parallel to the surface of the PCB. Cavity-backed antennas were implemented in PCB technology as well, especially at the higher frequencies. These antennas have dimensions on the order of the half-wavelength of the operating frequency, and at lower frequencies consume considerable PCB area.

Because of close proximity to the ground plane, however, PCB RF antennas typically have a narrow-band response, which is disadvantageous when wideband performance is needed, such as for ultra-wideband (UWB) operation in the 3.1-10.6 GHz band, or even a 6-8.5 GHz sub-band. Additional applications of interest are millimeter wave bands of the 57-71 GHz ("60 GHz") ISM band, 71-76 GHz and 81-86 GHz communications bands, and the 76-81 GHz automotive radar band. Covering these bands, or combinations thereof calls for antennas with large fractional bandwidth.

Thus, it would be desirable to have PCB antennas with enhanced bandwidth and improved wide-band matching characteristics. This goal is met by embodiments of the present invention.

SUMMARY

Antennas according to embodiments of the present invention include: at least one cavity in a planar substrate, such as a printed circuit board, integrated circuit, or a similar substrate; a radiating slot; and at least one strip resonator situated within a cavity, such that the signal port is coupled to a strip resonator. Locating a strip resonator within a cavity increases the efficiency and versatility of the antenna, while conserving space and allowing more volume and thickness to the cavity. Embodiments of the invention thereby provide antennas for PCBs and other planar substrates with both improved compactness form-factors and improved bandwidth characteristics.

Non-limiting examples according to embodiments of the present invention include a PCB antenna on a 1.6 mm thick FR4 substrate covering the 6-8.5 GHz band, and an antenna on a 1 mm thick PCB antenna covering a 57-90 GHz band.

The term "planar substrate" herein denotes a substrate whose surface substantially lies in a plane, which is arbitrarily referred to as a "horizontal" plane. With reference to the coordinate system legends in the accompanying drawings, the horizontal plane is denoted as the x-y plane, and the vertical direction is orthogonal thereto and denoted as the z-direction. Extents of width and length are expressed in the horizontal x-y plane, and extents of height, depth, and thickness are expressed in the z-direction. In various embodiments of the invention, the substrate's dimensions in the horizontal plane (i.e., its length and width) are substantially larger than the dimensions thereof in the vertical direction (i.e., its thickness). In certain embodiments of the present invention, a planar substrate is a PCB; in other embodiments, a planar substrate is an integrated circuit substrate. It is understood that descriptions and figures herein of embodiments relating to printed circuit boards are for illustrative and exemplary purposes, and are non-limiting. Operating principles of embodiments based on printed circuit board technology are in many cases also applicable to embodiments based on other technologies, such as integrated circuit technology.

According to embodiments of the invention, a planar substrate is formed of a dielectric material and contains electrically-conductive layers which extend horizontally within the substrate substantially parallel to the plane of the substrate. In PCB's, electrically-conductive layers are typically metallization layers.

According to embodiments of the present invention, a cavity in a planar substrate is a volumetric region containing a portion of the dielectric material of the substrate, and substantially bounded by portions of the electrically-conductive layers of the planar substrate to form a radio frequency (RF) cavity for electromagnetic fields. In certain embodiments, the horizontal boundaries of a cavity include portions of the horizontal electrically-conductive layers. In certain embodiments, such as those related to PCB use, the vertical boundaries of a cavity are formed by vertical electrical interconnections (e.g., vias) between adjacent horizontal metallization layers.

It is understood and appreciated that antenna embodiments according to the present invention include both transmission and reception capabilities. In descriptions herein where excitation of the antenna for transmission is detailed, it is understood that this is non-limiting, and that the same antenna is also capable of reception. Likewise, in cases of reception, the same antenna is also capable of transmission. Thus, for example, a "radiating slot aperture" (herein also denoted as a "radiating slot") is understood to be capable of receiving incoming electromagnetic radiation, in addition to transmitting outgoing electromagnetic radiation. In particular, various embodiments of the present invention are suitable for use in Radar, where a single antenna can handle both transmission and reception of signals.

Various embodiments of the invention feature different shapes for the radiating slot, including, but not limited to: a linear slot; an I-shaped (or H-shaped) slot; and a bow tie shaped slot.

Resonant transmission-line elements according to embodiments of the invention lie within the cavity and have a variety of boundary conditions. In some embodiments, a transmission line resonator is open at both ends; in other embodiments, a transmission line resonator is open at one end and shorted to ground at the other end.

In a related embodiment, the radiating slot is backed by a cavity having two transmission-line resonators disposed therein. The first transmission line resonator is excited by RF circuitry via a feed line, and the second transmission line resonator is excited by electromagnetic coupling to the first transmission line resonator. The cavity is excited primarily by the second resonator, and the radiating slot of the antenna is excited primarily by the fields within the cavity.

Another related embodiment features two vertically stacked cavities, with a coupling slot between the two cavities. The upper cavity includes in its top surface a radiating slot, wherein the lower cavity includes a half-wave open-open resonator driven by a feed line. (In this non-limiting embodiment, the upper cavity is the radiating cavity, and radiates upward; by rotating the configuration, of course, the terms "upper" and "lower" are interchanged, and the antenna radiates downward.)

Therefore, according to an embodiment of the present invention, there is provided a radio-frequency (RF) antenna for a planar substrate, the antenna including: (a) a dielectric material within the planar substrate; (b) a plurality of electrically-conductive layers within the planar substrate; (c) a cavity within the planar substrate, the cavity containing a portion of the dielectric material and bounded by portions of the electrically-conductive layers and by vertical sidewalls formed of electrically-interconnected portions of the electrically-conductive layers; (d) an antenna feed, for electromagnetically coupling the antenna to RF circuitry; (e) a radiating slot in the cavity, for electromagnetically coupling the antenna to an external RF field; and (f) at least two transmission line resonators disposed within the cavity; (g) wherein: at least one of the transmission line resonators is electromagnetically coupled to the antenna feed; and at least one of the transmission line resonators is electromagnetically coupled to the cavity.

In addition, according to another embodiment of the present invention, there is also provided a radio-frequency (RF) antenna for a planar substrate, the antenna including: (a) a dielectric material within the planar substrate; (b) a plurality of electrically-conductive layers within the planar substrate; (c) at least two cavities within the planar substrate, each cavity containing a portion of the dielectric material and bounded by portions of the electrically-conductive layers and by vertical sidewalls formed of electrically-interconnected portions of the electrically-conductive layers; (d) an antenna feed, for electromagnetically coupling the antenna to RF circuitry; (e) a radiating slot in one of the cavities, for electromagnetically coupling the antenna to an external RF field; and (f) at least one transmission line resonator disposed within at least one of the cavities; (g) wherein: the cavities are vertically stacked within the planar substrate; each cavity is vertically adjacent to another cavity of the at least two cavities; (h) each cavity shares a common electrically-conductive layer with an adjacent cavity; (i) each common electrically-conductive layer has disposed therein a slot which electromagnetically couples a cavity to the adjacent cavity thereof; (j) at least one of the transmission line resonators is electromagnetically coupled to the antenna feed; and (k) at least one of the transmission line resonators is electromagnetically coupled to one of the cavities.

Moreover, according to a further embodiment of the present invention, there is additionally provided a radio-frequency (RF) antenna for a planar substrate, the antenna including: (a) a dielectric material within the planar substrate; (b) a plurality of electrically-conductive layers within the planar substrate; (c) a single cavity within the planar substrate, the cavity containing a portion of the dielectric material and bounded by portions of the electrically-conductive layers and by vertical sidewalls formed of electrically-interconnected portions of the electrically-conductive layers; (d) an antenna feed, for electromagnetically coupling the antenna to RF circuitry; (e) a radiating slot in the cavity, for electromagnetically coupling the antenna to an external RF field; and (f) a single transmission line resonator disposed within the cavity; (g) wherein: the transmission line resonator is electromagnetically coupled to the antenna feed; and (h) the transmission line resonator is electromagnetically coupled to the cavity.

BRIEF DESCRIPTION OF THE DRAWINGS

The subject matter disclosed may best be understood by reference to the following detailed description when read with the accompanying drawings in which.

Figure 1:
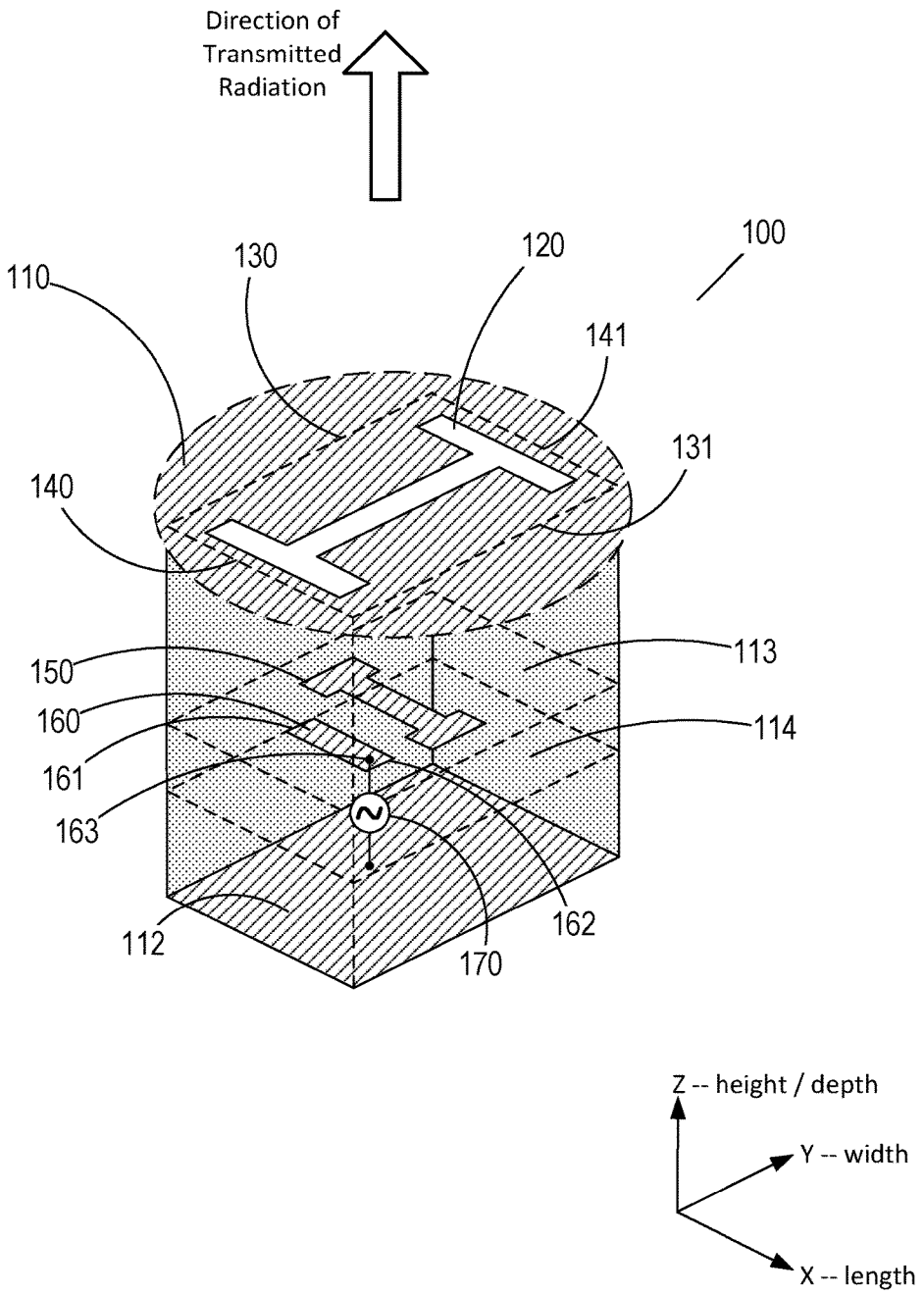
FIG. 1 is an isometric view of a cavity-backed slot antenna in a PCB, which is fed by two in-cavity transmission line resonators according to an embodiment of the present invention.

For simplicity and clarity of illustration, elements shown in the figures are not necessarily drawn to scale, and the dimensions of some elements may be exaggerated relative to other elements. In addition, reference numerals may be repeated among the figures to indicate corresponding or analogous elements.

To define the orientations of the illustrated elements, the drawings show the respective applicable coordinate system references. The direction along which the resonators are situated is denoted herein as the "x"-direction, with reference to the resonator "length"; the direction along which the radiating slots are situated is denoted herein as the "y"-direction, with reference to the slot "width"; and the direction along which the PCB layers are situated is denoted herein as the "z"-direction, with reference to the "height" or "depth" of elements with respect to the PCB strata.

DETAILED DESCRIPTION

FIG. 1 is an isometric view of an RF cavity-backed slot antenna 100 in a PCB, according to an embodiment of the present invention. A PCB top surface (only a portion of which is shown) is metallized to form a ground plane 110. A PCB bottom surface 112 is also metalized. A slot is etched in ground plane 110 to form a radiating slot 120, with transmitted radiation in the z-direction as shown. Slot 120 is backed by a cavity formed by sidewalls 130, 131, 140, and 141 (the intersections of which with top surface ground plane 110 are shown as dashed lines), top surface 110 and bottom surface 112, all of which are electrically conductive. The cavity is filled with a dielectric formed by the PCB substrate material. Cavity side walls 130, 131, 140, and 141 are typically fabricated by vertical "via" holes—holes with metallized sidewalls interconnecting the metallization layers of the PCB. In the embodiment of FIG. 1, two in-cavity resonators are present: a stepped-impedance open-open transmission line resonator 150, and a "short-open" transmission line resonator 160 (which is short-circuited to sidewall 130 at an end 161, and is open-circuited at an end 162). Resonators 150 and 160 are situated in PCB internal metallization layers 113 and 114, respectively. Resonator 160 is driven by an RF source 170 connected to resonator 160 at a point 163, in various ways according to additional embodiments of the invention, as described herein. (RF circuitry is not shown in the figures.)

Figure 2:
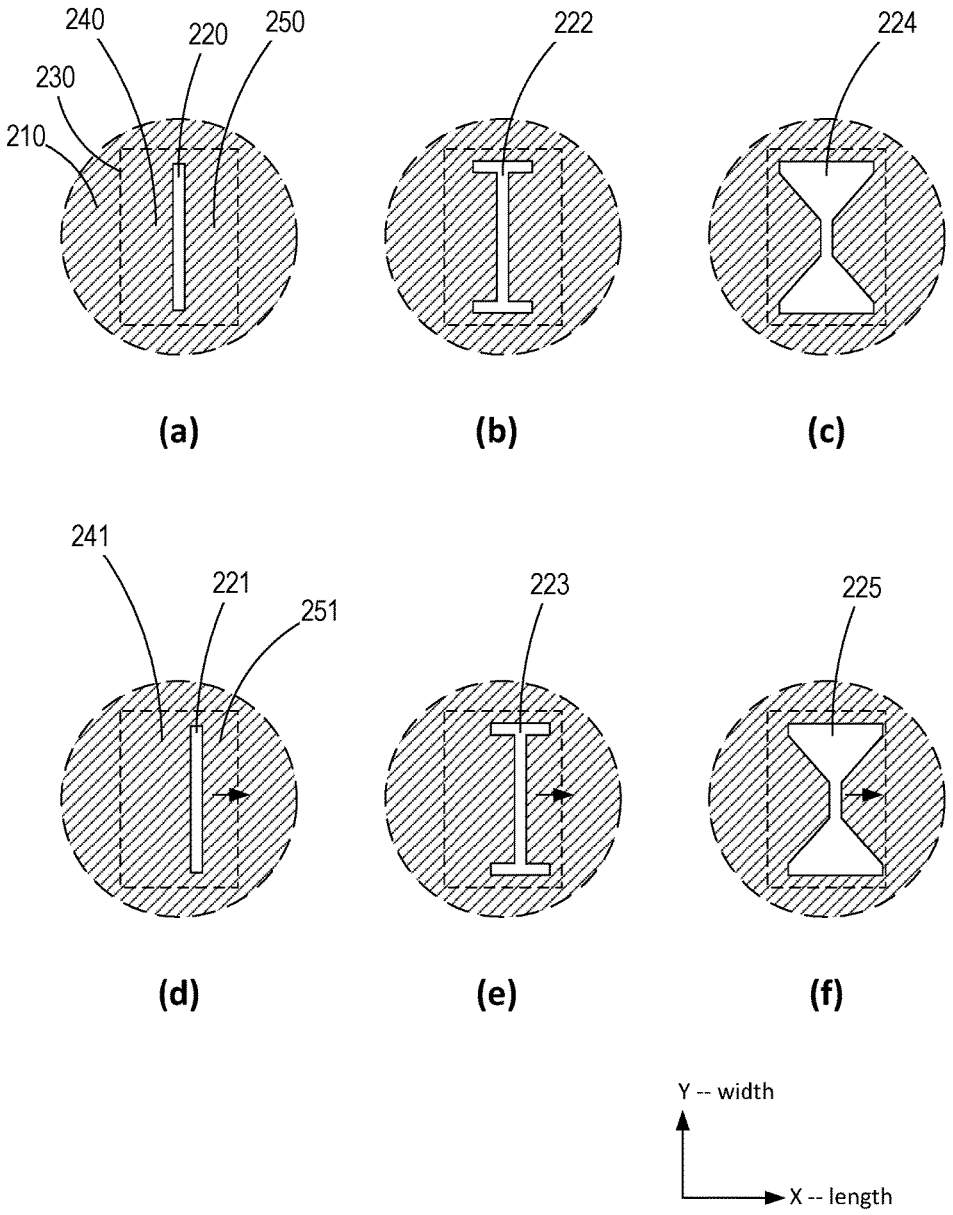
FIG. 2 illustrates a variety of non-limiting examples of antenna slot shapes according to embodiments of the present invention.

FIG. 2 illustrates configurations of radiating slots in a PCB ground plane 210 above a cavity having an intersection 230 (shown as a dashed line) with ground plane 210, according to several embodiments of the invention: FIG. 2 (*a*) shows a linear slot 220; FIG. 2 (*b*) shows an I-shaped (or H-shaped) slot 222; and FIG. 2 (*c*) shows a bow tie-shaped slot 224. These embodiments are non-limiting, as other shapes are also possible.

FIGS. 2 (*d*), FIG. 2(*e*), and FIG. 2 (*f*) show variants of the above slots offset from the cavity center. FIG. 2 (*d*) shows an offset linear slot 221; FIG. 2 (*e*) shows an offset I-shaped slot 223; and FIG. 2 (*f*) shows an offset bow tie-shaped slot 225. As noted above, additional offset shapes are also possible.

A metallization 240 on one side of the slot, and a metallization 250, on the other side of the slot, herein denoted as "flaps", define two sub-cavities. When the depth of the cavity is small relative to the length of the cavity, the flaps define two "short-open" resonators. In embodiments where the slot is offset from the center, flaps 241 and 251 have different resonant frequencies. This separation of frequencies allows further broadbanding of the antenna.

Figure 3:
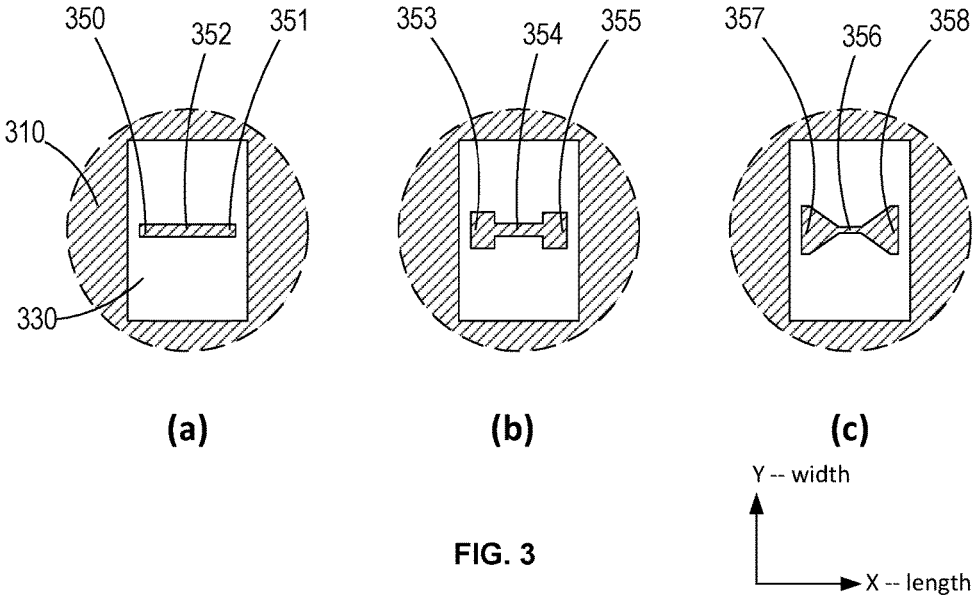
FIG. 3 shows a variety of non-limiting examples of in-cavity open-open transmission line resonator shapes according to embodiments of the present invention.

FIG. 3 illustrates configurations of intermediate "open-open" resonators in a PCB cavity 330 surrounded by a ground plane 310 according to several embodiments of the invention. FIG. 3 (*a*) illustrates a linear resonator 352 having an open-circuit side 350 and an open-circuit side 351; FIG. 3 (*b*) illustrates a stepped-impedance dumbbell-shaped resonator 354 having an open-circuit side 353 and an open-circuit side 355; and FIG. 3 (*c*) illustrates a tapered-impedance bow tie-shaped resonator 356 having an open-circuit side 357 and an open-circuit side 358. These embodiments are non-limiting, as other shapes are also possible.

Stepped-impedance resonators (such as resonator 354) are typically used to physically shorten the resonator for a better fit within the cavity. In FIG. 3 ground plane 310 has "open-open" resonators contained within cavity 330. The two sides of the respective resonators form "quarter wave" sections, which in typical cases are coupled, respectively, to flaps 241 and 251 of FIG. 2. The amount of coupling between the resonator and the slot is controlled by the height at which the resonator is situated and by its width. Just as the slot can be offset from the center of the length, so can the resonator be offset, so that the relative amount of coupling of one side to flap 241, and the other side to flap 251 can be controlled. As noted previously, the implications and the benefits of using offset configurations are disclosed below.

Figure 4:
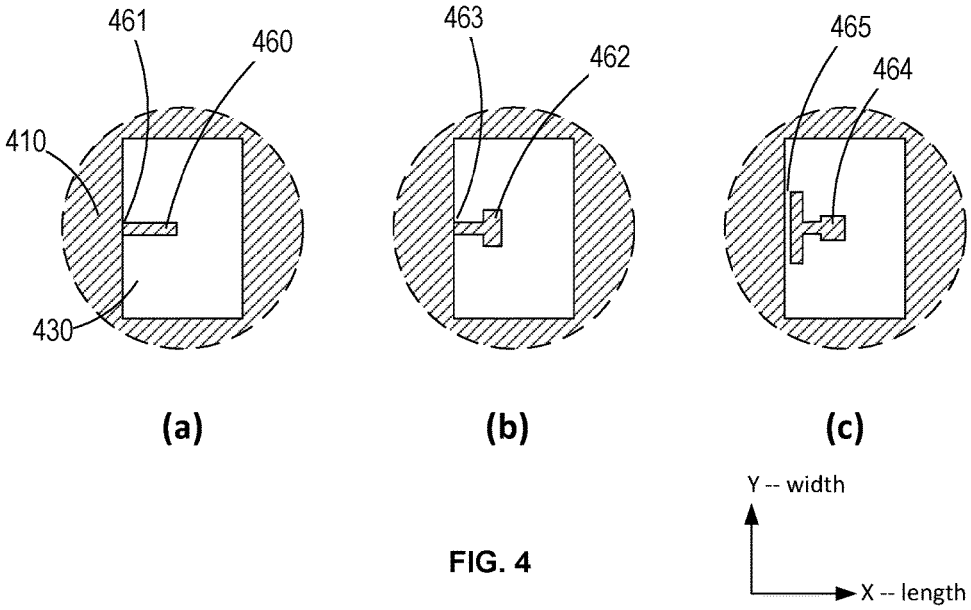
FIG. 4 shows a variety of non-limiting examples of in-cavity short-open transmission line resonator shapes according to embodiments of the present invention.

FIG. 4 illustrates configurations of "short-open" resonators, which are typically used as driven elements, in a PCB cavity 430 surrounded by a ground plane 410 according to several embodiments of the invention. FIG. 4 (*a*) illustrates a linear resonator 460 having a short-circuit connection 461 to ground plane 410; FIG. 4 (*b*) illustrates a stepped-impedance resonator 462 having a short-circuit connection 463 to ground plane 410; and FIG. 4 (*c*) illustrates a stepped-impedance resonator 464 having a capacitive stub 465 serving in place of a short-circuit connection to ground plane 410. The configuration of FIG. 4 (*c*) is beneficial if galvanic (direct current) contact with ground plane 410 is to be avoided. These embodiments are non-limiting, as other shapes are also possible.

In FIG. 4, the resonator is typically close to the cavity edge—and in 4 (*a*) and 4 (*b*) the resonator is galvanically-connected to the cavity edge—so that a resonator of FIG. 4 and one of the sides of an "open-open" resonator of FIG. 3 together approximate a quarter wave coupled section. The amount of coupling between a "short-open" resonator of FIG. 4 and an "open-open" resonator of FIG. 3 is controlled by the respective heights at which the resonators are situated and by their respective widths.

Figure 5:
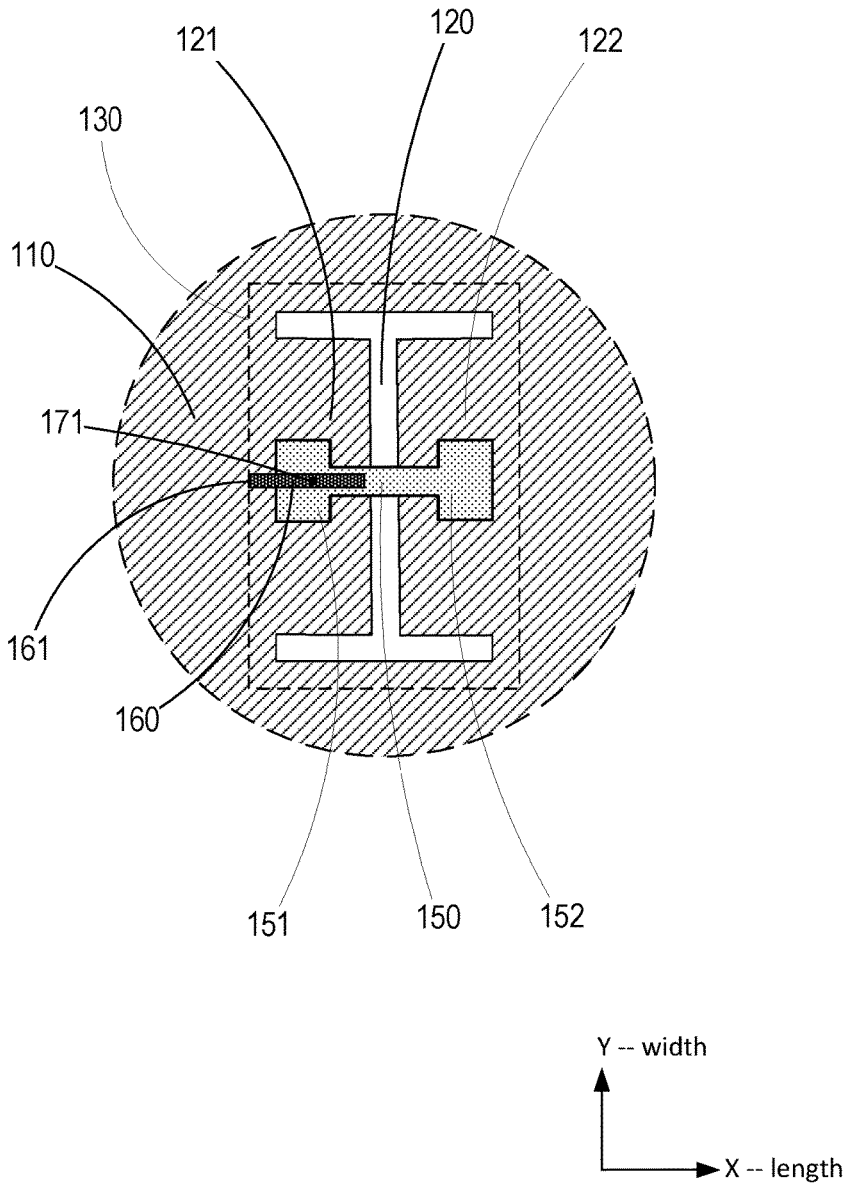
FIG. 5. Illustrates relative position in the X-Y plane of resonators, according to embodiments of the present invention.

FIG. 5 shows a plan view of the antenna of FIG. 1, to illustrate the relative placement of the antenna components. FIG. 5 shows the antenna from the bottom side, with ground plane 112 removed. Intermediate resonator 150 extends across slot 120, so that sides 151 and 152 extend under slot 120's two side flaps 121 and 122, respectively. The transmission line resonator 150 is coupled to "short-open" resonator 160 in view of their overlap in the x-y plane. Resonator 160 has a short-circuit connection 161 to sidewall 130. The coupling factors between the resonators are determined by their respective heights above ground plane 112 (not shown in FIG. 5), the spacing between the resonators in the z-direction, their amount of overlap in the x-direction, and by their widths in the y-direction. Typically, the heights of the resonators are chosen within the constraints of PCB manufacturing technology ("stackup" of the layers), so that the resonator dimensions and amount of overlap are modified to adjust the coupling factors between the resonators in the antenna. The location of a feed point 171 along resonator 160 determines the coupling factor to resonator 160. The overall set of coupling factors determines the frequency response of the antenna and is chosen to provide a uniform response over the frequency range of interest.

Figure 6:
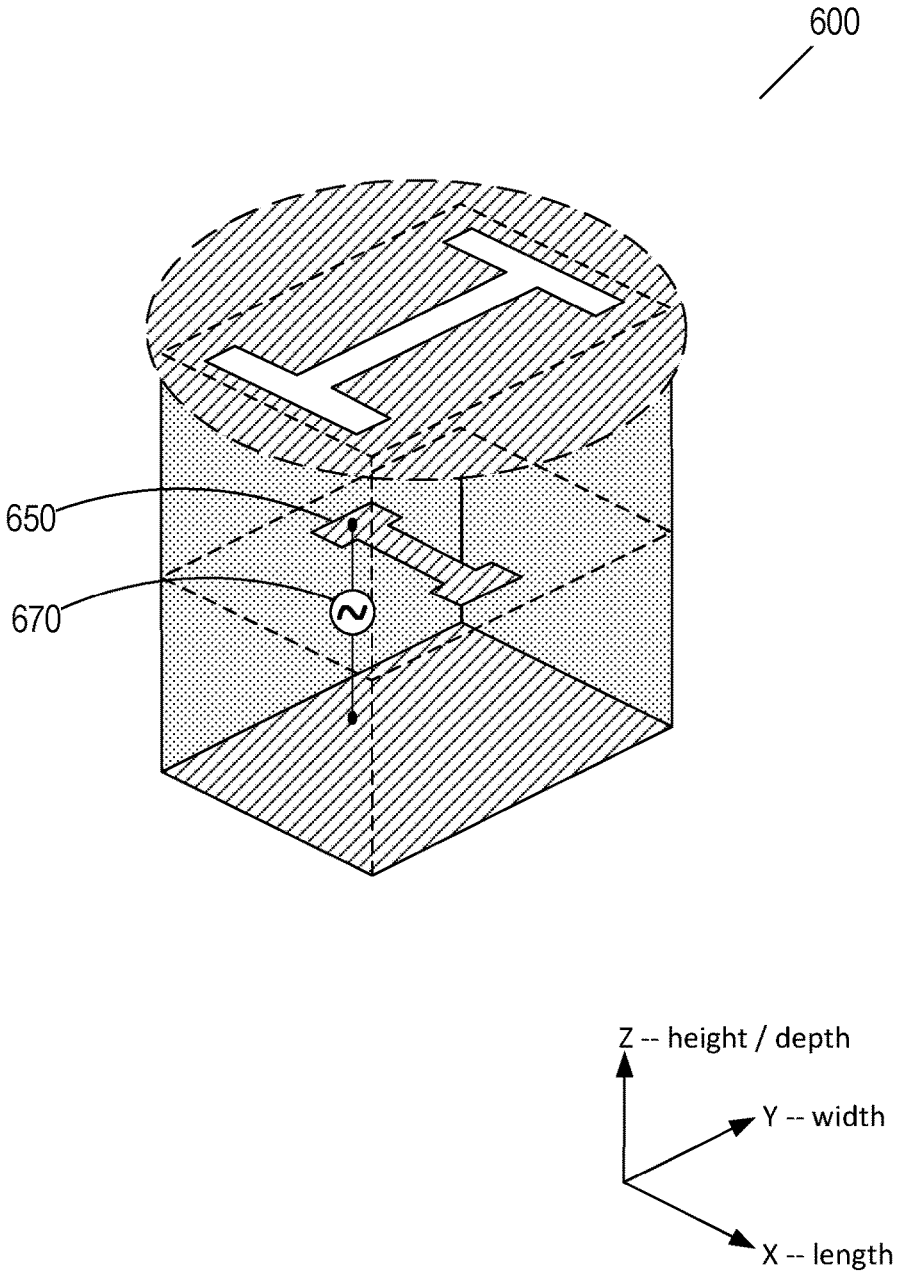
FIG. 6 is an isometric view of a cavity-backed slot antenna on a PCB which is fed by an open-open in-cavity transmission line resonator according to an embodiment of the present invention.

FIG. 6 shows an antenna 600 according to another embodiment of the present invention, wherein the cavity contains only one "open-open" resonator 650, which is directly driven by an input source 670. Antenna 600 permits simpler PCB stackups, at the expense of reducing the order of the filter in the antenna.

Figure 7:
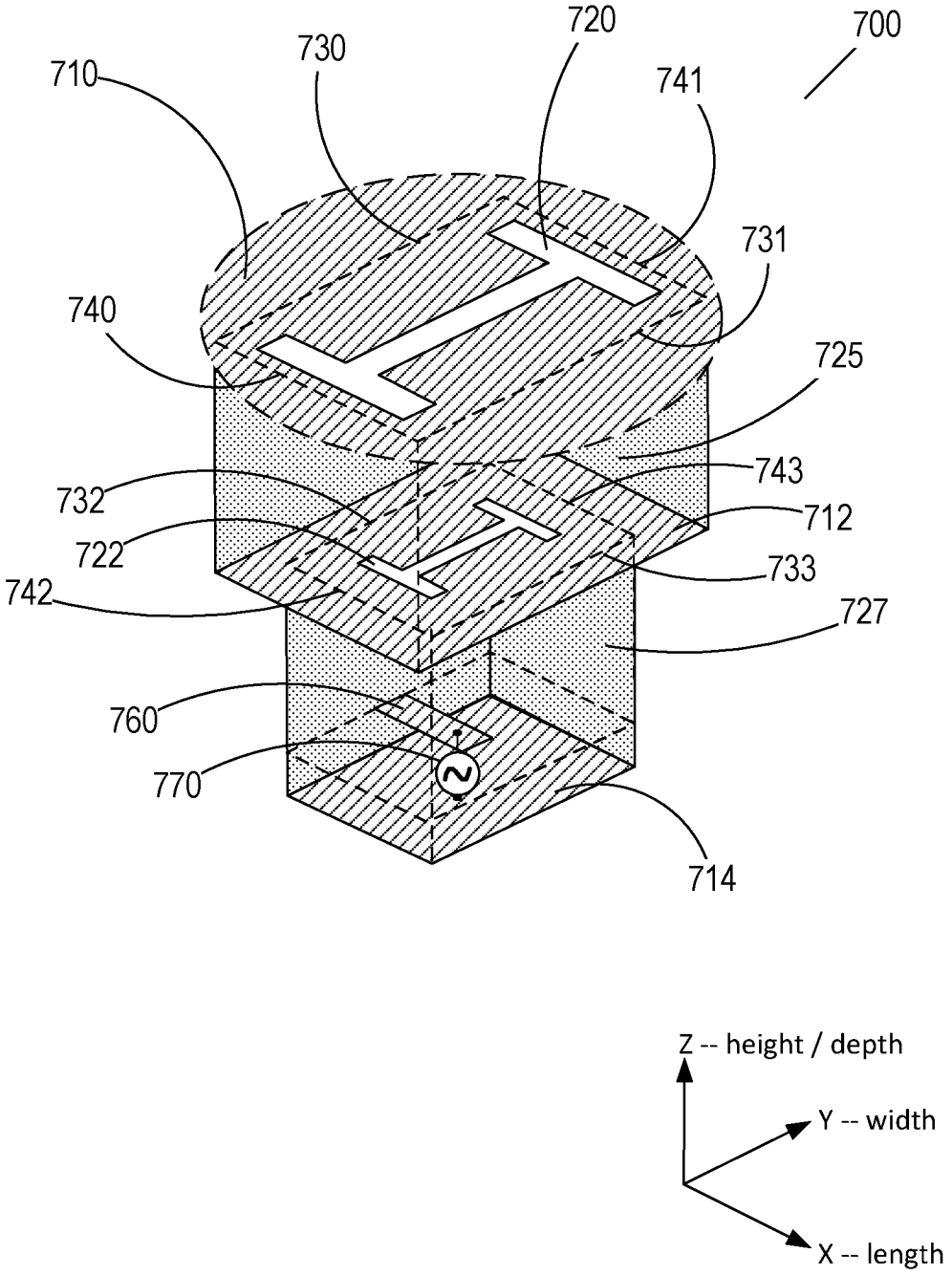
FIG. 7 is an isometric view of a cavity-backed slot antenna on a PCB having two vertically stacked slot-coupled cavities according to an embodiment of the present invention.

FIG. 7 illustrates an antenna 700 according to an embodiment of the present invention, in which there are two vertically stacked PCB cavities: an upper cavity 725 having sidewalls 730, 731, 740, and 741 (shown as dashed lines); and a lower cavity 727 having sidewalls 732, 733, 742, and 743 (shown as dashed lines). Lower cavity 727 is coupled to upper cavity 725 through a slot 722 in a surface 712 which is common to both cavities. A top surface 710 contains a radiating slot 720. Lower cavity 727 contains therein a "short-open" resonator 760 that couples to lower cavity 727. Antenna 700 forms a filter structure, with transmission line resonator 760, lower cavity 727 and upper cavity 725 being coupled in tandem to achieve broadband response.

Antenna 700, with two PCB cavities one above the other is particularly applicable to antenna arrays, where one objective is to pack multiple antennas with a high surface density. This is advantageous over current technologies such as SIW (surface integrated waveguide) antennas coupled to additional SIW resonators which are laterally displaced in the same plane and thereby consume excessive PCB surface area.

In-cavity transmission line resonators according to embodiments of the current invention typically have narrow width dimension relative to the length dimension, as opposed to patch antennas. The purpose of the cavity elements of the present invention is not to radiate, but rather to couple energy to the radiating cavity-slot combination.

According to related embodiments of the current invention, transmission line resonators are offset from the center of the cavity in the y-direction, to advantageously alter the coupling factor between the resonator and the cavity, as previously discussed.

In another embodiment of the invention, transmission line resonators (such as resonators 150 and 160 of FIG. 1) are placed side by side at the same height within a cavity, so that the resonators are side-coupled rather than broadside-coupled.

As previously noted regarding the above descriptions directed to PCB technology, it is understood by those skilled in the art that embodiments of the present invention are also applicable to other technologies which feature multiple layers of dielectric and various forms of electrically-conductive layers, such as LTCC (low-temperature co-fired ceramic) and other implementation of high-frequency antennas on integrated circuits.

Figure 8:
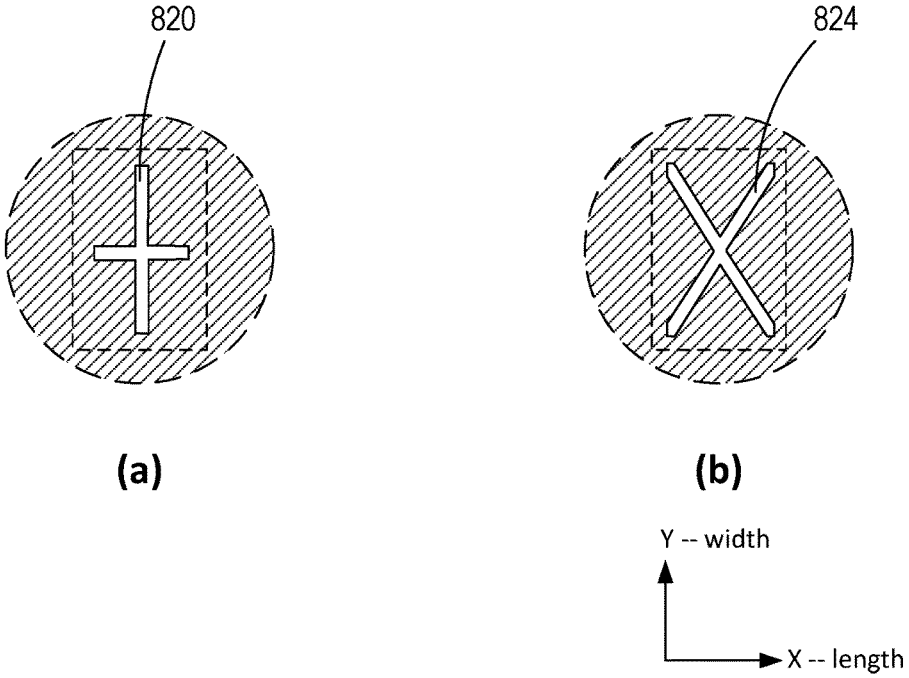
FIG. 8 illustrates slot shapes for dual polarization and circular polarization according to certain embodiments of the present invention.
Figure 9:
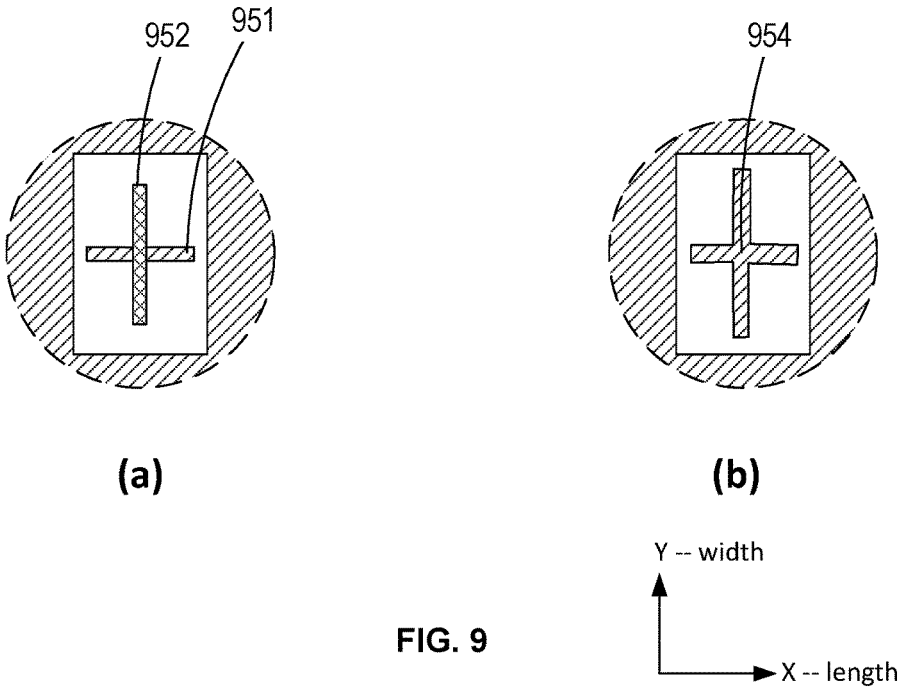
FIG. 9 illustrates transmission line resonator shapes for dual polarization and circular polarization according to other embodiments of the present invention.

It is also understood by those skilled in the art that embodiments of the present invention are also applicable to dual and circular polarization antennas. By having cavities and slots resonant in both x and y dimensions, and by having in-cavity transmission line resonators supporting more than one resonance mode, an antenna can function for multiple polarizations. FIG. 8 (*a*) illustrates a slot 820 with a "+" shape, and FIG. 8 (*b*) illustrates a slot 824 with an "x" shape—these have resonant modes in both the "x" and "y" directions. Resonances can be at the same or different frequencies, according to the relative dimensions. FIG. 9 (*a*) illustrates a resonator 951 and an orthogonally-oriented resonator 952, which together support resonances in both "x" and "y" polarizations; and FIG. 9 (*b*) illustrates a "+" shaped resonator 954 to support two resonant modes. In another embodiment, separate feed resonators are used for each polarization; in a further embodiment, a single feed is used to couple to both polarizations. The above-mentioned features can be used in antennas including, but not limited to: dual polarization antennas at same frequency band with two feed points; dual polarization antennas with different (and possibly overlapping) frequency bands with two feed points; dual polarization dual self-diplexing band antennas; circular polarization antennas, by frequency-staggering resonance frequencies in two polarizations; circular polarization antennas, by 90-degree feeding of the two polarization; and dual-circular polarization antennas by quadrature-hybrid based feeding of the two polarizations.

It is further understood by those skilled in the art that embodiments of the present invention are applicable not only for radiating into free space or a dielectric medium, but also for radiating into a waveguide, so as to use these embodiments as a waveguide launcher, by adjusting the antenna parameters accordingly. An array of waveguide launchers according to present invention can be used for low-loss distribution of multiple signals, for example to antenna array elements in a large-aperture array.

Additional Non-Limiting Examples

As an additional non-limiting example, an antenna covering the 6-8.5 GHz band is implemented on a 1.6 mm thick PCB, using a 10-layer FR4-based stackup. The antenna uses a 10.5 mm long, 18 mm wide cavity, with a bow-tie slot having a 0.4 mm gap at the center. The intermediate open-open resonator is 9.95 mm long. The driven short-open resonator uses a virtual ground formed by capacitive stubs, to avoid a galvanic (direct current) connection to ground. The cavity walls are formed by dense rows of adjacent vias.

As a further non-limiting example, an antenna covering the 58-85 GHz band features two stacked cavities, with the upper cavity of dimensions 1.85 mm long, 2.65 mm wide, 0.7 mm high, and having a slot occupying most of the top surface. The cavity sidewalls are formed by rows of vias. The lower cavity is 0.95 mm long, 1.65 mm wide, and 0.3 mm high. The lower cavity sidewalls are formed by rows of vias, and the cavities are interconnected by an I-slot. The lower cavity is excited by a short-open resonator, which is 0.3 mm long and 0.2 mm wide.

What is claimed is:

1. A radio-frequency (RF) antenna for a planar substrate, the antenna comprising:

a dielectric material within the planar substrate;

a plurality of electrically-conductive layers within the planar substrate;

a cavity within the planar substrate, the cavity containing a portion of the dielectric material and bounded by portions of the electrically-conductive layers and by vertical sidewalls formed of electrically-interconnected portions of the electrically-conductive layers;

an antenna feed, for electromagnetically coupling the antenna to RF circuitry;

a radiating slot in the cavity, for electromagnetically coupling the antenna to an external RF field; and at least two transmission line resonators disposed within the cavity such that the at least two transmission line resonators are respectively situated in different electrically-conductive layers;

wherein:

at least one of the transmission line resonators is electromagnetically coupled to the antenna feed;

at least one of the transmission line resonators is electromagnetically coupled to the cavity; and at least two of the transmission line resonators are electromagnetically-coupled to each other.

2. The RF antenna of claim 1, wherein the radiating slot is selected from a group consisting of:

a linear slot;

an I-shaped slot; and a bow tie-shaped slot.

3. The RF antenna of claim 1, wherein at least one of the transmission line resonators is selected from a group consisting of:

a short-open uniform resonator;

a short-open stepped impedance resonator;

a short-open tapered resonator;

an open-open uniform resonator;

an open-open stepped impedance resonator; and an open-open tapered resonator.

4. The RF antenna of claim 1, wherein the antenna feed electromagnetically couples the antenna to the RF circuitry by a connection selected from a group consisting of:

a galvanic connection; and a capacitive coupling.

5. The RF antenna of claim 1, wherein the planar substrate is a printed circuit board (PCB), and wherein the electrically-conductive layers are metallization layers.

6. The RF antenna of claim 5, wherein metallization layers are interconnected by a plurality of vias in the PCB.

7. The RF antenna of claim 1, wherein the planar substrate is within an integrated circuit (IC).

8. The RF antenna of claim 1, wherein the at least two resonators have a predetermined horizontal overlap and are parallel to each other.

9. The RF antenna of claim 8, wherein the predetermined horizontal overlap adjusts a coupling factor between the at least two resonators.

10. A radio-frequency (RF) antenna for a planar substrate, the antenna comprising:

a dielectric material within the planar substrate;

a plurality of electrically-conductive layers within the planar substrate;

at least two cavities within the planar substrate, each cavity containing a portion of the dielectric material and bounded horizontally at the top and at the bottom by respective portions of two different electrically-conductive layers, and bounded vertically at all sides by vertical sidewalls formed of electrically-interconnected portions of the electrically-conductive layers;

an antenna feed, for electromagnetically coupling the antenna to RF circuitry;

a radiating slot in one of the at least two cavities, for electromagnetically coupling the antenna to an external RF field; and at least one transmission line resonator disposed within at least one other of the cavities;

wherein:

the cavities are vertically stacked within the planar substrate;

each cavity is vertically adjacent to another cavity of the at least two cavities;

each cavity shares a common electrically-conductive layer with an adjacent cavity;

each common electrically-conductive layer has disposed therein a slot which electromagnetically couples a cavity to the adjacent cavity thereof;

at least one of the transmission line resonators is electromagnetically coupled to the antenna feed; and at least one of the transmission line resonators is electromagnetically coupled to one of the cavities.

11. The RF antenna of claim 10, wherein the radiating slot is selected from a group consisting of:

a linear slot;

an I-shaped slot; and a bow tie-shaped slot.

12. The RF antenna of claim 10, wherein a transmission line resonator is selected from a group consisting of:

a short-open uniform resonator;

a short-open stepped impedance resonator;

a short-open tapered resonator;

an open-open uniform resonator;

an open-open stepped impedance resonator; and an open-open tapered resonator.

13. The RF antenna of claim 10, wherein the antenna feed electromagnetically couples the antenna to the RF circuitry by a connection selected from a group consisting of:

a galvanic connection; and a capacitive coupling.

14. The RF antenna of claim 10, wherein the planar substrate is a printed circuit board (PCB), and wherein the electrically-conductive layers are metallization layers.

15. The RF antenna of claim 14, wherein metallization layers are interconnected by a plurality of vias in the PCB.

16. The RF antenna of claim 10, wherein the planar substrate is within an integrated circuit (IC).

* * * * *